United States Patent [19]

Surber, III et al.

[11] Patent Number: 4,902,412

[45] Date of Patent: Feb. 20, 1990

[54] SWIMMING POOL WATER RECIRCULATION SYSTEM

[75] Inventors: William O. Surber, III; Robert E. Gartin, both of Houston, Tex.

[73] Assignee: Wizzz-Rd Corp., Houston, Tex.

[21] Appl. No.: 212,275

[22] Filed: Jun. 27, 1988

[51] Int. Cl.[4] ..... E04H 3/20

[52] U.S. Cl. ..... 210/169; 210/174; 210/355; 210/416.2; 241/69; 241/46 B

[58] Field of Search ..... 210/169, 416.2, 173, 210/174, 353, 354, 355, 107; 241/69, 46 B, 152 R

[56] References Cited

U.S. PATENT DOCUMENTS

| | | | |
|---|---|---|---|
| 3,313,332 | 4/1967 | Stephan et al. | 241/152 R |
| 3,618,774 | 11/1971 | Delphia | 210/169 |
| 4,430,214 | 2/1984 | Baker | 210/169 |
| 4,602,746 | 7/1986 | Stöckmann et al. | 241/216 |
| 4,607,802 | 8/1986 | Lamort | 241/46 B |
| 4,640,467 | 2/1987 | Takeuchi | 241/152 R |

FOREIGN PATENT DOCUMENTS

| | | | |
|---|---|---|---|
| 247342 | 12/1987 | European Pat. Off. | 241/152 R |
| 1250604 | 12/1960 | France | 241/46.1 |
| 1287459 | 12/1986 | Japan | 241/152 R |

*Primary Examiner*—W. Gary Jones
*Assistant Examiner*—Coreen Y. Lee
*Attorney, Agent, or Firm*—Vaden, Eickenroht, Thompson & Boulware

[57] ABSTRACT

There is disclosed a water recirculation system for a swimming pool including assemblies installed in the drain openings in the skimmer and lower end of the pool for shredding leaves solely in response to the circulation of water through them.

11 Claims, 4 Drawing Sheets

SWIMMING POOL WATER RECIRCULATION SYSTEM

This invention relates generally to a water recirculation system for a swimming pool. More particularly, it relates to a system of this type having improved means for removing leaves or other relatively large particles of debris from the pool.

A system of this type includes conduit means connecting one or more drain openings from the pool with an inlet to the pool, a pump in the conduit means for recirculating the water from the drain openings to the inlet, and a sand or other type of filter in the conduit means downstream of the pump for collecting particles of debris. These particles are periodically removed from the filter, as by reverse circulation, and, in some cases, the system may include a gravity trap upstream of the pump for collecting large particles.

Modern pools have drain openings not only in the bottom of the pool, but also in one or more skimmers about the edge of the pool. Heavier particles will of course pass into the drain opening in the bottom of the pool and lighter articles which float on the water surface will pass into the drain opening in the skimmer. In either case, a porous basket may be mounted in the drain opening to collect leaves and other larger particles. These baskets must of course be removed and cleaned as the particles build up within them and impede passage of the water and smaller particles therethrough.

U.S. Pat. No. 4,430,214 shows a water recirculation system of this type wherein a screen is installed across the inlet to the pump and cutter means comprising blades are mounted on an extension of the impeller shaft of the pump for rotation across the upstream side of the screen. The cutter blades rotate within a passageway connecting a trap with the inlet to the pump so as to shred leaves or other large particles which are not caught in a gravity trap upstream of the pump. The screen openings are of such size that the shredded particles will pass through the pump and into the sand filter downstream of the pump.

This arrangement would of course require substantial retrofitting of an existing system. Also, the blades are inaccessible for replacement or repair without disassembly of the pump and trap. In addition, although shredded, the larger of the particles may quickly clog up the filter and require its frequent flushing.

An object of this invention is to provide a water recirculation system in which, as in the above described system, leaves or other large particles are shredded to a size which may pass through the pump, but which does not require extensive, if any, retrofitting of an existing system and which has parts which are readily accessible for replacement or repair. A more particular object is to provide such a system which requires less frequent cleaning of the filter.

Still another object is to an assembly for so shredding the leaves which may be installed or removed as a unit within or from either or both of a drain opening in the bottom of the pool or the drain opening in a skimmer of an existing water recirculation system, which is of inexpensive construction, and which is easily assembled and unassembled for replacement or repair.

These and other objects are accomplished, in accordance with the illustrated embodiment of the invention, by a system having means for shredding the leaves which comprises a passageway forming a continuation of one or both of the drain openings, cutter means having blades which are rotatable across the upstream side of the screen, and means for rotating the blades solely in response to the flow of water passing through the opening. More particularly, the cutter blades are rotated by means of rotor blades closely rotatable within the passageway. Due to their location apart from the pump, and instead within the drain opening, the cutter and rotor blades are easily accessible for replacement and repair. Preferably, the leaf shredding means comprises an assembly which includes a housing having a passageway therethrough which, when the housing is seated in the drain opening, forms a continuation of the drain opening, and on which the cutter blades, screen and rotor blades are mounted to permit installation and removal of the assembly without the need to retrofit the system.

As illustrated, the rotor blades are connected to the cutter blade by a shaft which extends through the screen so that they rotate downstream of the screen, and the lower end of the shaft is supported radially by an open cage at the lower end of the housing.

In the drawings, wherein like reference characters are used throughout to indicate like parts:

Figure 1:
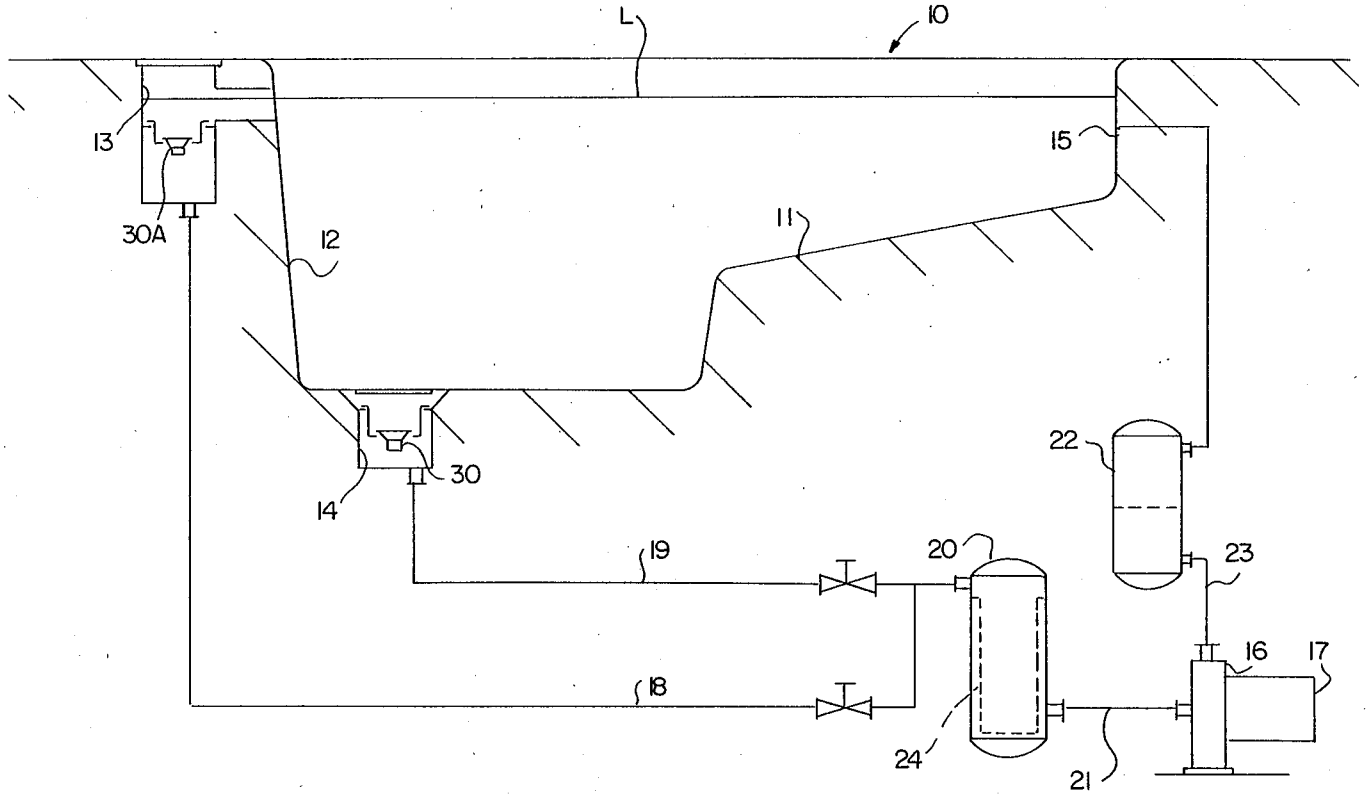
FIG. 1 is a cross-sectional view of a swimming pool water circulation system including a diagrammatic illustration of leaf shredding assemblies constructed in accordance with the present invention installed in the drain openings in both a skimmer and the bottom of the pool.

With reference now to the details of the above described drawings, the system shown diagrammatically in FIG. 1 includes a pool 10 having a bottom wall 11 and side walls 12 to contain water therein at a level L, and conduit means connecting a drain opening 13 in a skimmer at the edge of one side of the pool and a drain opening 14 in the bottom of the pool with an inlet 15 to the pool. More particularly, a pump 16 having a motor 17 is installed in the conduit means for recirculating the water from the drain openings to the inlet.

As shown, the conduit means includes a first conduit 18 leading from the skimmer drain opening, and a second conduit 19 leading from the drain opening in the bottom of the pool. The conduits 18 and 19 are connected to one another for connection to a separator tank 20 which in turn is connected to the pump inlet by means of a conduit 21. A conventional sand filter 22 is installed in a conduit 23 leading from the pump outlet to the pool inlet 15.

The separator tank 20 includes an upright tank having a porous basket 24 therein whose upper end is at a level beneath inlet from the conduits 18 and 19 so as to permit particles of debris to be collected in the basket prior to passage of the water through conduit 21 into the pump. As well known in the art, the tank is of such construction as to permit this basket to be removed and emptied from time to time.

Figure 2:
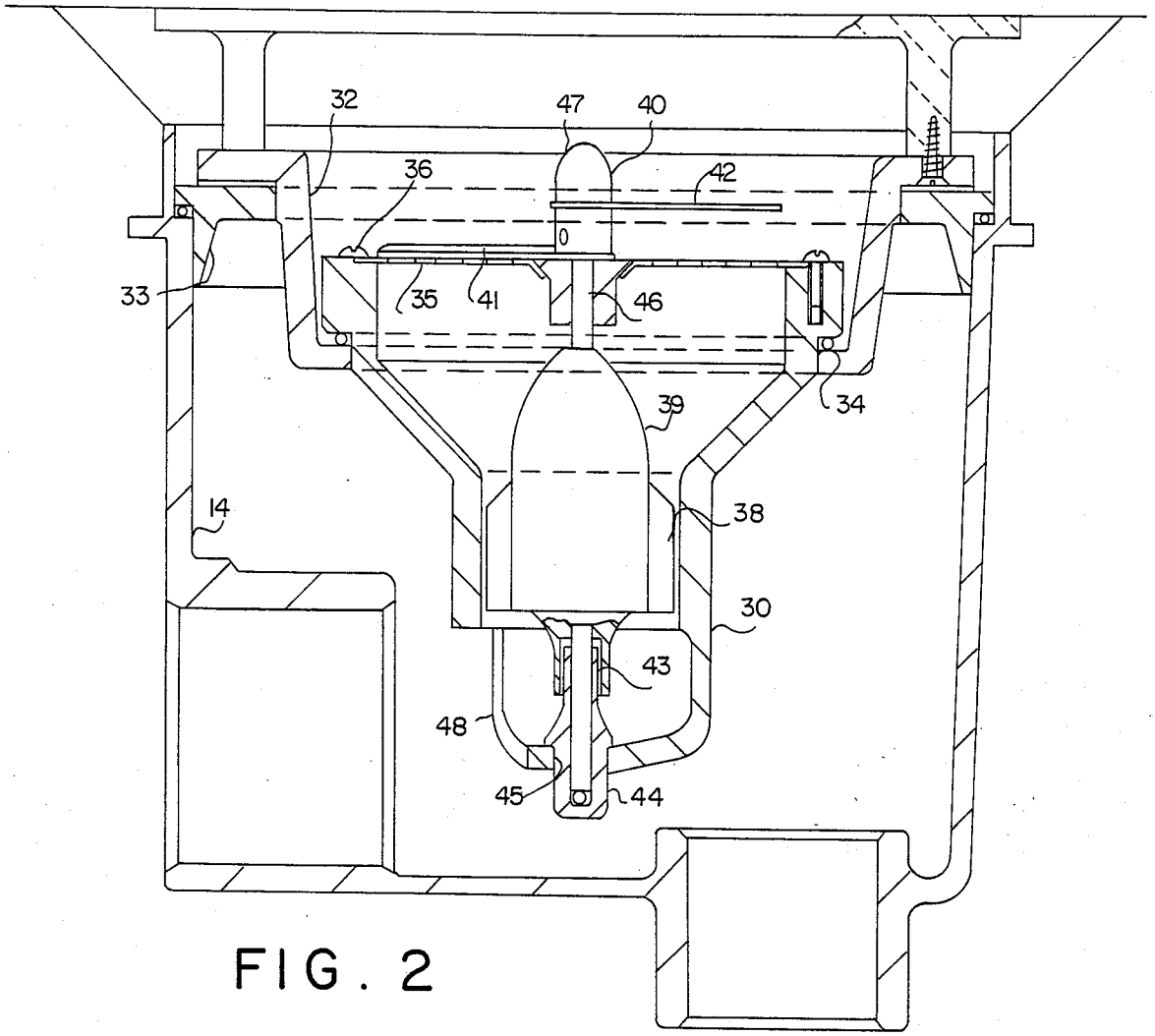
FIG. 2 is an enlarged vertical-sectional view of one of the assemblies installed in the drain opening of the skimmer.

As shown in FIG. 2, the drain opening 14 in the bottom of the pool has an inlet in its upper end and an outlet therefrom to one side of its lower end. The assembly installed in the opening comprises a housing 30 having a passageway 31 therethrough and adapted to be supported on a lip within the open end of a bowl 32 having a flange about its upper end for resting upon an adapter ring 33, which in turn is mounted on an annular seat within the opening and on which the above described baskets are adapted to be supported in conventional water circulations systems of this type. More particularly, a flange about the upper end of the housing 30 is adapted to be supported upon an O-ring 34 resting upon the lip about the open lower end of the bowl from which the body is supported. Thus, the passageway 31 through the housing 30 forms a continuation of the drain opening so that the water passing through the drain opening is confined for flow through the passageway.

A screen 35 is mounted across the open upper end of passageway 31 and held in place thereon by means of screws 36 threaded to the flange about the upper end of the housing. The lower end of the housing 30 comprises a cage 37 having side openings 48 therethrough, and an intermediate portion of the passageway 31 is reduced to closely receive rotor blades 38 extending from a rotor body 39 rotatably supported on the cage 37.

The assembly further includes cutter means 40 having a pair of cutter blades 41 and 42 mounted thereon and connected to the rotor body for rotation therewith above the screen 35. More particularly, the rotor body 39 includes a lower shaft 43 axially and radially supported within a bearing 44 received within a bore 45 in the lower end of the cage, and an upper shaft 46 which extends through a hole in the screen 35 and which is threadedly connected to an upper body or head 47 of the cutter means 40 on which the blades 41 and 42 are mounted.

Figure 4:
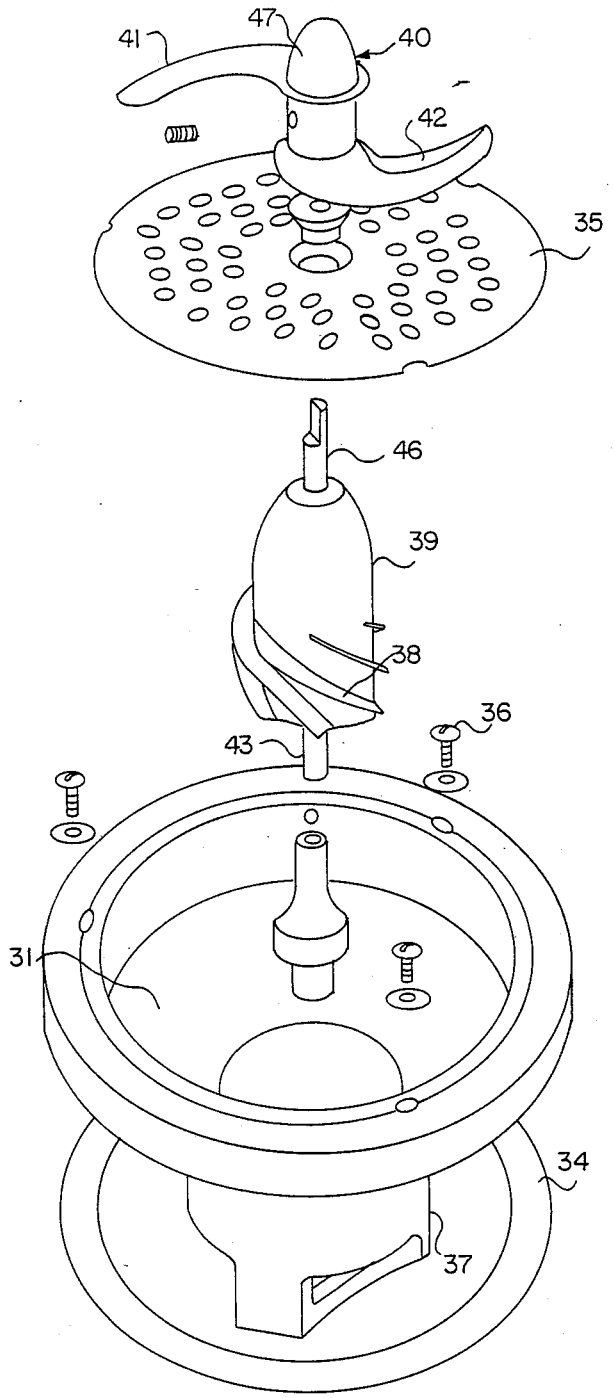
FIG. 4 is an exploded view of the parts of the assembly of FIG. 2.

As best shown in the exploded view of FIG. 4, the rotor blades 38 are formed on a helix so as to cause the rotor body, and thus the cutter blades to be rotated in response to the passage of water through the passageway 31 during circulation between the drain opening and the inlet back to the pool. The blades 41 and 42 are diagrammatically opposed to one another, with blades 41 having a flat portion close to the upper surface of the screen 35, and blade 42 having a flat portion spaced above the screen. Thus, the primary purpose of the blade 41 is to shred leaves and other relatively large particles which extend partly through the holes in the screen, while the primary purpose of the blade 42 is to shred portions of the leaves which project above the screen and which otherwise might not be shredded by blade 41.

The bearing 44 may be formed of a self-lubricating material, and lubricant may also be contained within the lower end of the bearing beneath the lower end of the shaft 45 to lubricate the surfaces between the bore of the bearing and the shaft as well as a ball beneath the lower end of the shaft. A labyrinth type seal is formed by an upper extension of the bearing 44 disposed within a lower extension of the rotor body 39 to form an air pocket within the upper end of the annular space between them and thus prevent water from flowing into the space between the bearing surfaces.

As will be appreciated from the foregoing, the various parts of the above described assembly are connected to one another as a unit so as to permit their installation within or removal from the positions shown in FIG. 2 as a unit. Furthermore, this installation merely requires seating of the housing of the assembly within the bowl and mounting of the bowl within an adapter, the adapter serving primarily to permit the assembly to be used within openings of different diameters. It would also be appreciated that the blades may be easily removed for replacement or repair upon removal of the head 40 from the upper end of shaft 46.

Figure 3:
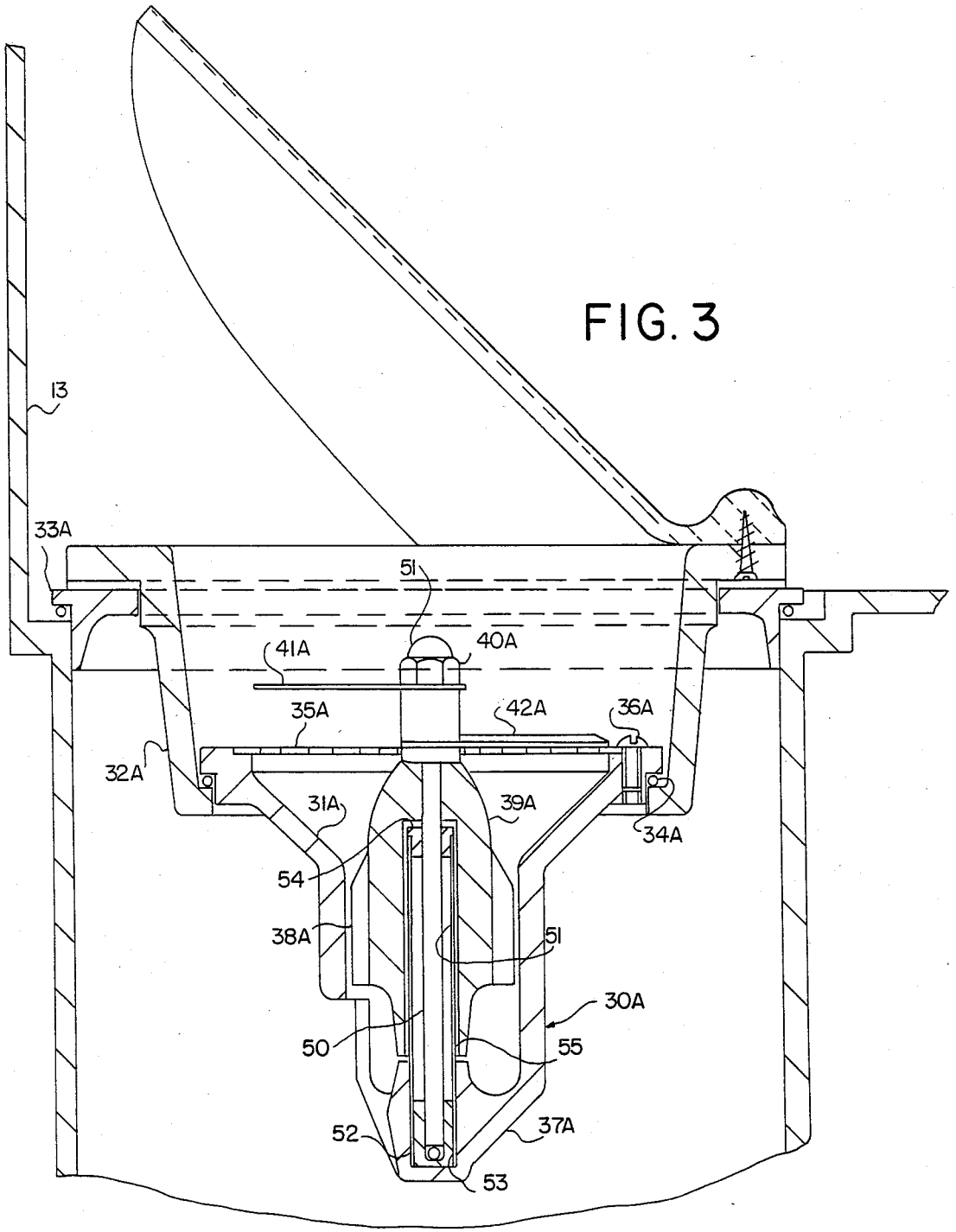
FIG. 3 is an enlarged vertical cross-sectional view of the assembly installed in the drain opening in the bottom of the pool.

The assembly shown in FIG. 3 to be installed in the drain opening 13 of the skimmer is similar to that above described. In this case, of course, the skimmer has a side opening at the edge of the pool into which water flows for passage through and out the lower end of the drain opening into the conduit 18. As in the case of the assembly in the drain opening in the bottom of the pool, the assembly shown in FIG. 3 includes a housing 30A having a passageway 31A therethrough and mounted within the open lower end of a bowl 32A supported from an adapter ring 33A mounted on a seat about the drain opening. More particularly, a flange about the upper end of the passageway 31A of the body 30A is supported on an 0-ring 34A carried by a flange about the open lower end of the dish 32A so that the passageway 31A forms a continuation of the drain opening 13 in the skimmer.

As in the case of the previously described assembly, a screen 35A is mounted across the open upper end of the passageway 31A and held thereon by means of screws 36A. Also, an intermediate portion of the passageway 31A is reduced to closely receive helically formed blades 38A extending from the rotor body 39A. More particularly, a cutter means 40A is connected to the rotor body 39A and includes diametrically opposed blades 41A and 42A which rotate with the rotor blades 38A in response to the flow of water through the passageway 31A as it is recirculated.

The primary difference between the assemblies resides in the manner in which the rotor housing is supported by the assembly housing. Thus, as shown in FIG. 3, a reduced upper end of the rotor 39A extends through a hole in the screen 35A, and the blades 41A and 42A of the cutter means 40 are mounted on the upper body extension for rotation therewith. More particularly, a single shaft 50 extends through the body 39A, with its upper end threadedly connected to a nut 51 to hold the blade 41A down upon the upper body extension, and the blade 42A are connected to the extension just above its projection through the screen.

The lower end of the shaft 50, on the other hand, extends through a counterbore 51 in the lower end of the rotor body 39A and has its lower end received within a bearing sleeve 52 within a counterbore 53 formed within the cage 37A. More particularly, another bearing sleeve 54 surrounds an intermediate portion of the shaft 50 within the upper end of the counterbore 51A, and a tube 55 extends between the bearing sleeves 54 and 52 in spaced relation to the counterbore 51. Lubricant may be contained within the annular space between the shaft and the tube 55 above the bearing 52 and about the ball in the sleeve 52 beneath the lower end of the shaft. Thus, as in the case of the assembly of FIG. 2, the lubricant and bearing surfaces between the shaft and bearing are protected from water flowing through the assembly by means of a labyrinth type seal which traps air within the annular space between the sleeve 55 and the counterbore 51 to prevent water from flowing upwardly through it and into the bearing surfaces.

Reviewing now the operation of the overall system, the pump 16 will cause water to be recirculated through each of the assemblies where leaves or other relatively large particles of debris within the pool are caused to be shredded to relatively small sizes. The larger of these shredded particles are separated within the basket 24 of the separator tank 20 before entry into the pump 16. Thus, only the smaller shredded particles are circulated through the pump and into the filter 22. In this way, the filter will become clogged at much less frequent intervals, thereby requiring it to be backwashed less frequently.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. In a swimming pool water recirculation system including conduit means connecting one or more drain openings in the pool with an inlet thereto, a pump in the conduit means for recirculating water from each drain opening to the inlet, and a filter in the conduit means downstream of the pump, the improvement comprising a screen across a passageway forming a continuation of the drain opening, cutter means including at least one blade mounted for rotation across the upstream side of the screen, and means responsive to the flow of water through the passageway for rotating the cutter means.

2. In a system as defined in claim 1, wherein the drain opening is in the bottom of the pool.

3. In a system as defined in claim 1, wherein the drain is in a skimmer at the edge of the pool.

4. In a system as defined in claim 1, wherein the drain opening is in each of the bottom of the pool and within a skimmer at the edge of the pool.

5. In a system as defined in claim 1, wherein the improvement further includes a separator tank in the conduit means upstream of the filter.

6. In a swimming pool water recirculation system including conduit means connecting one or more drain openings in the pool with an inlet thereto, a pump in the conduit means for recirculating water from each drain opening to the inlet, and a filter in the conduit means downstream of the pump, the improvement comprising a screen across a passageway forming a continuation of the drain opening, cutter means including at least one blade mounted for rotation across the upstream side of the screen, and a rotor body including helical blades closely rotatable within the passageway and connected to the cutter blades for rotating them with the rotor body responsive to the flow of water through the passageway.

7. In a system as defined in claim 6, wherein the rotor blades rotate within the passageway downstream of the screen and are connected to the cutter blade by a shaft which extends through the screen.

8. An assembly installed within and removable from the drain opening of a swimming pool recirculation system, comprising a housing adapted to be seated within the drain opening and having a passageway therethrough which, when the housing is so seated, forms a continuation of the drain opening, a screen mounted across the passageway of the housing, cutter means including at least one blade connected to the shaft for rotating across the upstream side of the screen, and means including rotor blades connected to the cutter blades for rotating closely within the passageway on the downstream side of the screen in response to the circulation of water therethrough.

9. An assembly as defined in claim 8, wherein the cutter means includes a pair of diametrically opposed blades one of which moves closely over the upstream side of the screen and the other of which is spaced above the screen.

10. An assembly as defined in claim 8, wherein the rotor blades are connected to the cutter blades by a shaft which extends through the screen, the housing includes an open cage at the downstream end of the passageway, and the lower end of the shaft is supported axially and radially within a bearing in the cage.

11. An assembly as defined in claim 10, including a labyrinth type seal providing an air space which protects the bearing from the water passing through the assembly.

* * * * *